US009915131B2

(12) United States Patent
Ziauddin et al.

(10) Patent No.: US 9,915,131 B2
(45) Date of Patent: Mar. 13, 2018

(54) METHODS USING FLUID STREAM FOR SELECTIVE STIMULATION OF RESERVOIR LAYERS

(75) Inventors: Murtaza Ziauddin, Abu Dhabi (UA); Andrew Parry, Bourg la Reine (FR); Moussa Kane, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 12/037,397

(22) Filed: Feb. 26, 2008

(65) Prior Publication Data

US 2008/0210427 A1 Sep. 4, 2008

Related U.S. Application Data

(60) Provisional application No. 60/904,708, filed on Mar. 2, 2007.

(51) Int. Cl.
*E21B 43/26* (2006.01)
*E21B 43/114* (2006.01)

(52) U.S. Cl.
CPC ..... *E21B 43/114* (2013.01); *E21B 43/26* (2013.01)

(58) Field of Classification Search
CPC . C09K 8/72; C09K 8/74; C09K 8/528; C09K 8/62; C09K 8/60; E21B 37/00
See application file for complete search history.

(56) References Cited

U.S. PATENT DOCUMENTS 2,327,051 A 8/1943 Lyons et al.
2,371,383 A * 3/1945 Dismukes ..... 166/290
2,771,141 A * 11/1956 Lewis ..... 166/222
4,679,629 A * 7/1987 Abdo et al. ..... 166/281
5,462,129 A 10/1995 Best et al.
5,547,023 A * 8/1996 McDaniel ..... E21B 43/025 166/280.1
5,765,642 A * 6/1998 Surjaatmadja ..... 166/297
6,006,828 A 12/1999 Kluth et al.
6,006,838 A 12/1999 Whiteley et al.
6,059,032 A * 5/2000 Jones ..... 166/278
7,137,448 B2 11/2006 Di Lullo Arias et al.
7,654,318 B2 2/2010 Cooper et al.
2002/0109080 A1* 8/2002 Tubel et al. ..... 250/227.14
2003/0062162 A1 4/2003 Middaugh et al.
(Continued)

FOREIGN PATENT DOCUMENTS

EP 0679797 A2 4/1995

OTHER PUBLICATIONS

Austrian Examination Report issued in GCC/P/2008/10262 dated Sep. 20, 2011, 3 pages.
(Continued)

*Primary Examiner* — Angela M DiTrani

(74) *Attorney, Agent, or Firm* — Michael L. Flynn; Robin Nava

(57) ABSTRACT

A technique enables stimulation of a subterranean formation. A reactive fluid is delivered downhole into a wellbore. The reactive fluid is under sufficient pressure downhole to create a jet of the reactive fluid that is directed at a specific treatment section. The jet is maintained until a localized region of enhanced permeability is created. One or more jets can be created or moved to treat a plurality of low permeability zones.

19 Claims, 6 Drawing Sheets

(56) References Cited

U.S. PATENT DOCUMENTS

| | | | | |
|---|---|---|---|---|
| 2003/0164252 | A1 | 9/2003 | Rae et al. | |
| 2004/0206494 | A1* | 10/2004 | Stephenson et al. | 166/250.1 |
| 2006/0070740 | A1* | 4/2006 | Surjaatmadja | E21B 43/114 166/308.1 |
| 2006/0231253 | A1* | 10/2006 | Vilela et al. | 166/278 |

OTHER PUBLICATIONS

Mexican Office Action issued in MX/A/2009/009338 dated Apr. 4, 2012, 8 pages.
International Search Report issued in PCT/IB2008/050710 dated Jun. 13, 2008, 3 pages.
Written Opinion issued in PCT/IB2008/050710 dated Sep. 2, 2009, 5 pages.
Eurasian Office Action for Eurasian Application No. 200970825 dated Jul. 26, 2013.
Examination Report for Canadian Application No. 2,679,584 dated Mar. 6, 2015.

* cited by examiner

CONTOURS OF X VELOCITY (M/S)

METHODS USING FLUID STREAM FOR SELECTIVE STIMULATION OF RESERVOIR LAYERS

CROSS-REFERENCE TO RELATED APPLICATION

The present document is based on and claims priority to U.S. Provisional Application Ser. No. 60/904,708, filed Mar. 2, 2007, hereby incorporated by reference in its entirety.

BACKGROUND

Hydrocarbons (oil, natural gas, etc.) are obtained from a subterranean geologic formation, i.e. a reservoir, by drilling a well that penetrates the hydrocarbon-bearing formation, thus causing a pressure gradient that forces the fluid to flow from the reservoir to the well. Often, well production is limited by poor permeability either due to naturally low permeability formations or due to formation damage that typically arises from prior well treatment, such as drilling.

To increase the net permeability of a reservoir, a well stimulation treatment can be performed. A common stimulation technique includes injecting an acid that reacts with and dissolves the damaged portion or other formation portion having naturally low permeability. The injection of acid creates alternative flow paths for the hydrocarbons to migrate through the formation to the well. The technique is known as acidizing (or more generally as matrix stimulation) and may eventually be associated with fracturing if the injection rate and pressure is sufficient to induce formation of a fracture in the reservoir.

Fluid placement is important for the success of stimulation treatments. Natural reservoirs often are heterogeneous, and the injected fluids tend to enter areas of higher permeability in lieu of entering areas where the stimulation fluid is most needed. Each additional volume of fluid follows the path of least resistance and continues to invade zones that have already been treated. Therefore, difficulty arises in placing the treating fluids in severely damaged formation zones and other low permeability formation zones.

Various techniques have been employed to control placement of treating fluids. For example, mechanical techniques involve the use of ball sealers, packers and coiled tubing placement to specifically spot the fluid across the zone of interest. Non-mechanical techniques often make use of gelling agents as diverters for temporarily impairing the areas of higher permeability and increasing the proportion of the treating fluid that flows into areas of lower permeability.

SUMMARY

In general, the present invention provides a system and method for stimulating a subterranean formation. A reactive fluid is delivered downhole into a wellbore. The reactive fluid has sufficient pressure downhole to create a jet, i.e. pressurized stream, of the reactive fluid that is directed at a specific treatment section. The jet is maintained until a localized region of enhanced permeability is created. This process can be repeated as desired to treat a plurality of low permeability zones.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for stimulating a subterranean formation. A reactive fluid is delivered downhole into a wellbore, and the reactive fluid is discharged as a stream, i.e. jet, under sufficient pressure to impinge a treatment section of the formation having low permeability. The jet is maintained until a localized region of enhanced permeability is created. A plurality of jets can be used simultaneously to create localized regions of enhanced permeability. Additionally, the one or more jets can be moved to sequential treatment sections of the formation.

The methodology enables selective placement of treating fluids using a combination of mechanical and chemical techniques. According to one embodiment of the invention, a stream or jet of reactive fluid is aimed at the wellbore wall to create the local region of enhanced permeability. If the jet/stream is held stationary over this region, the localized region is dissolved or eroded, and the dissolved or eroded region grows deeper into the treatment section of the reservoir until it has penetrated a desired distance. For example, the penetration may be designed to enable nearby treating fluid to be attracted to the treatment area and thus further enhance the rate of penetration or erosion into the reservoir.

After the desired penetration/erosion has been achieved, the stream of reactive fluid can be moved to another zone of interest, and the process can be repeated. By maintaining the stream a sufficient length of time at each localized treatment section, the initial permeability distribution along the well can be substantially changed. Thus, subsequent fluid placement in the reservoir is optimized via the regions treated by the stream rather than being subjected solely to the initial, or natural, permeability distribution along the well. Because the stream/jet can be moved independently of the initial permeability distribution, the methodology enables selective stimulation of reservoir layers.

Figure 1:
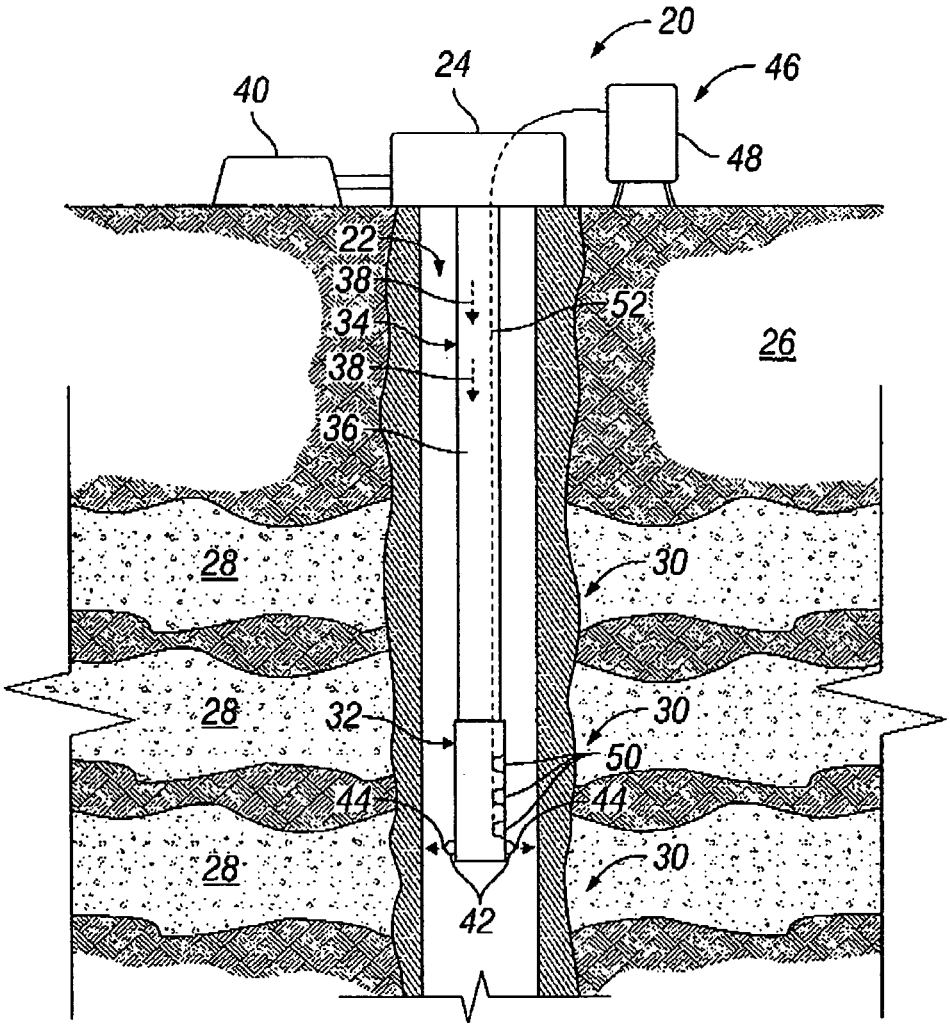
FIG. 1 is a front elevation view of a well system that can be used to stimulate a subterranean formation, according to an embodiment of the present invention.

Referring generally to FIG. 1, one embodiment of a well treatment system 20 is illustrated as deployed in a wellbore 22. The wellbore 22 extends downwardly from a wellhead 24 and into or through a formation 26. Formation 26 may have a plurality of reservoir layers 28 having sections 30 of low permeability. By way of example, the sections 30 may be regions that naturally have a low permeability. However, the low permeability also can result from damage to the formation as a result of, for example, drilling operations.

In the example illustrated, system 20 comprises a well tool or stimulation tool 32 deployed downhole by a conveyance 34. Conveyance 34 may comprise a tubing 36 in the form of, for example, production tubing or coiled tubing. A reactive fluid may be pumped down through tubing 36, as represented by arrows 38. In the embodiment illustrated, the reactive fluid is pumped from a surface pumping system 40, down through tubing 36, and into well tool 32. The reactive fluid is pressurized by surface pumping system 40 and/or its hydrostatic head to enable discharge of the reactive fluid through one or more jet nozzles 42. The jet nozzles 42 are positioned on well tool 32 and oriented to discharge a stream or jet of the reactive fluid, as represented by arrows 44. The fluid jet (or jets) 44 is directed at a specific treatment section along, for example, a wall of wellbore 22.

System 20 also may comprise a monitoring system 46 having a surface acquisition unit or control unit 48 coupled to one or more sensors 50. The one of more sensors 50 are able to communicate with service unit 48 via an appropriate communication line 52 which may be a wired (such as by a fiber optic communication line 52 or the like) or wireless communication line. At least one sensor 50 may be positioned to monitor penetration of the jet stream 44. However, other sensors 50 also can be used to monitor a variety of downhole parameters. Data from sensors 50 is relayed uphole to surface unit 48 for use in monitoring and controlling the well stimulation operation. System 20 may also comprise components and/or elements and/or systems disclosed in commonly assigned and co-pending Ser. No. 11/562,546, published as US2007/0289739, incorporated herein by reference in its entirety.

Figure 2:
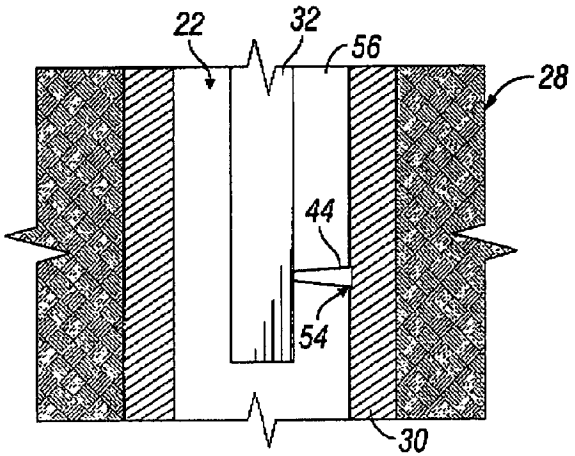
FIG. 2 is a schematic illustration of a stimulation tool creating a jet of stimulation fluid in a wellbore, according to an embodiment of the present invention.

Referring generally to FIG. 2, an illustration is provided that shows a stream or jet 44 of reactive fluid discharged from well tool 32 and directed at a specific treatment section 54 along wellbore 22. The reactive fluid may be an acidic fluid, such as a hydrochloric acid fluid, but the reactive fluid also may be a neutral fluid, a basic fluid, or another type of reactive fluid able to penetrate or erode the region of low permeability 30. As described above, the region of low permeability 30 can result from the natural formation or it can result from formation damage due to drilling or other downhole procedures.

Figure 3:
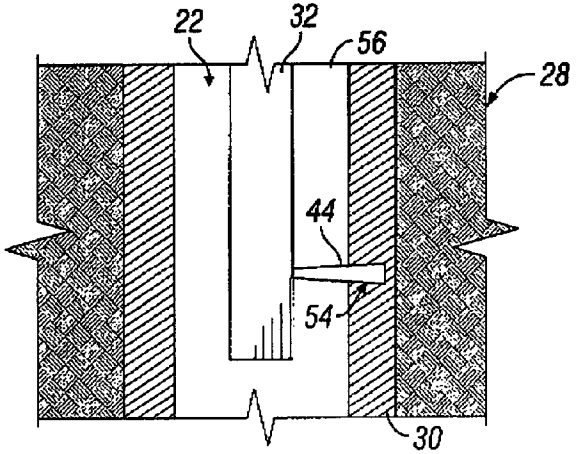
FIG. 3 is a schematic illustration similar to that of FIG. 2 but showing partial penetration into a low permeability region, according to an embodiment of the present invention.
Figure 5:
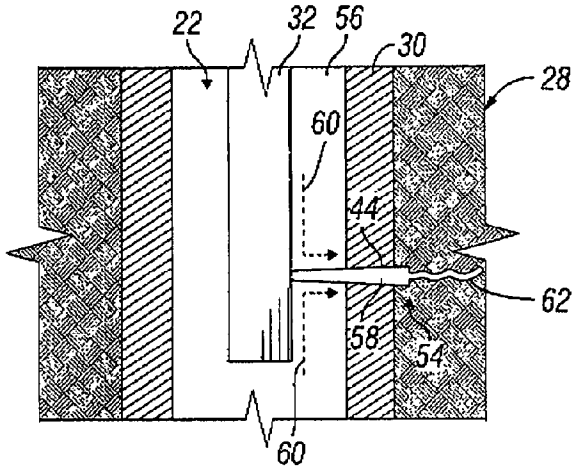
FIG. 5 is a schematic illustration similar to that of FIG. 2 but showing penetration through a low permeability region and the creation of worm holes in the formation matrix, according to an embodiment of the present invention.
Figure 4:
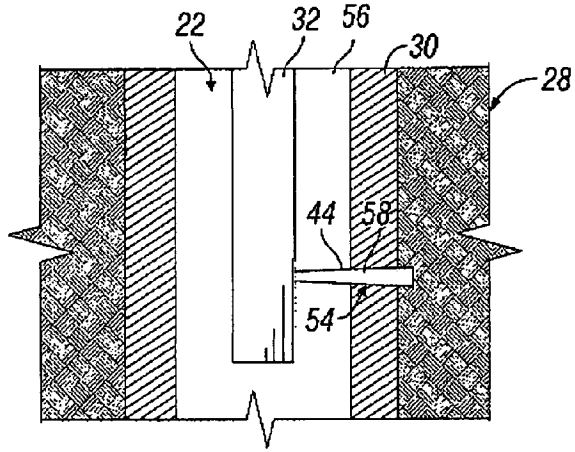
FIG. 4 is a schematic illustration similar to that of FIG. 2 but showing penetration through a low permeability region, according to an embodiment of the present invention.

In FIG. 2, the jet 44 of reactive fluid is illustrated as penetrating and/or at least partially dissolving a layer of filter cake 56 along wellbore 22. Once through the layer of filter cake 56, the jet impinges against the region of low permeability 30 and begins to erode and/or dissolve the low permeability reservoir material, as illustrated in FIG. 3. In the example illustrated, region 30 may comprise a carbonate rock layer behind the filter cake layer 56. The jet 44 is maintained at treatment section 54 until the stream of fluid erodes/dissolves the low permeability material and creates a passageway 58 through the low permeability material 30, as illustrated in FIG. 4. Once the low permeability region is bypassed, the newly created region of enhanced permeability attracts reactive fluid, e.g. acid, from wellbore 22, as illustrated by arrows 60 of FIG. 5. As the reactive fluid moves through passageway 58, it initiates formation worm holes 62 which further increase the permeability of the formation and attract more reactive fluid from wellbore 22. As a result, the region of enhanced permeability can grow much deeper into the formation than the initial cavity created by jet 44.

The simulation methodology is amenable to use in predominantly carbonate formations. However, suitable reactive fluids can be selected to enable enhancement of permeability at specific treatment zones in other types of formations, such as predominantly sandstone formations. Additionally, the methodology can be used to clean out perforations or gravel packs in non-open hole completions. In many applications, the localized regions of enhanced permeability are initially created to facilitate the subsequent flow of a primary treatment fluid into the desired zones during the main treatment procedure. In any of these applications, sensors 50 can be used to monitor penetration of stream 44 and to optimize the treatment in, for example, real-time. The position and orientation of the jet or jets 44 can be adjusted with a variety of mechanisms, including stabilizers and centralizers.

Figure 6:
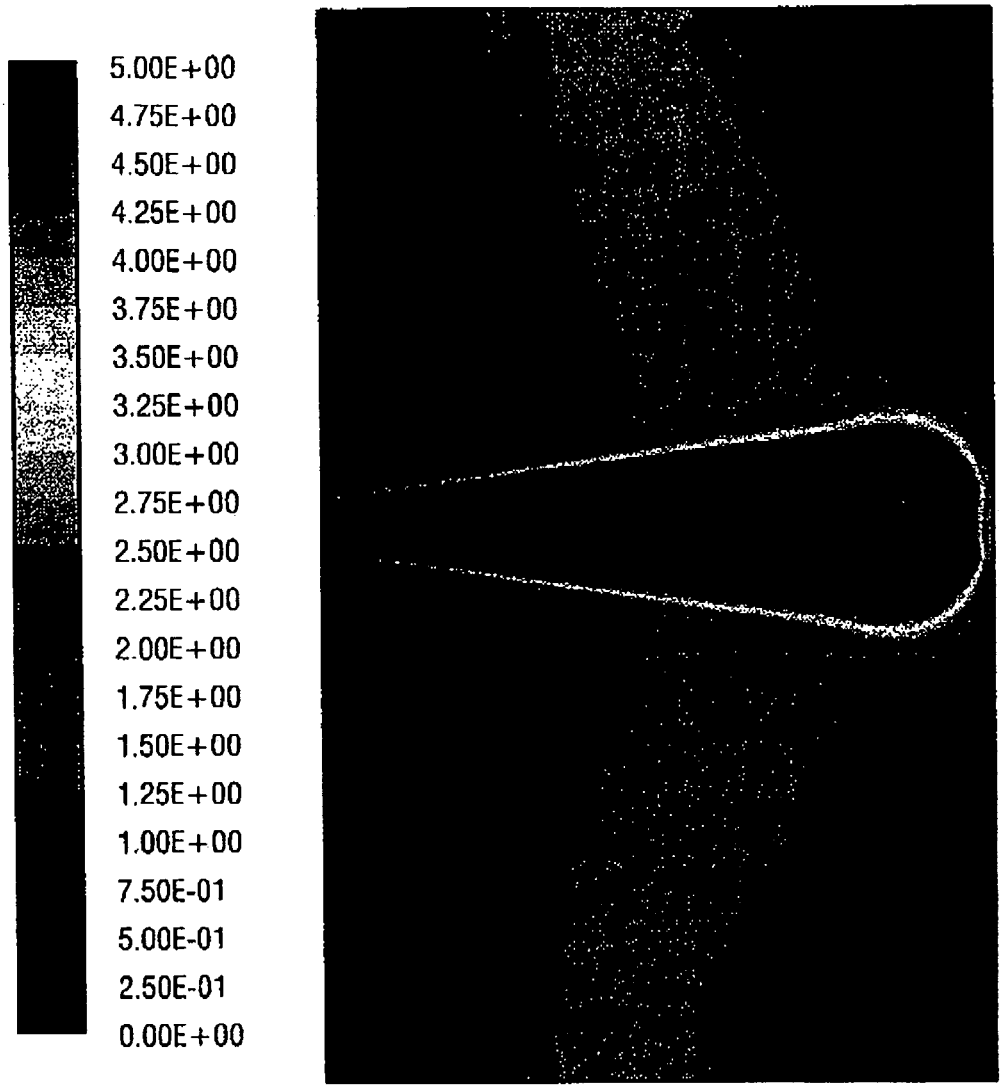
FIG. 6 is a graphical illustration of a velocity contour, according to an embodiment of the present invention.
Figure 7:
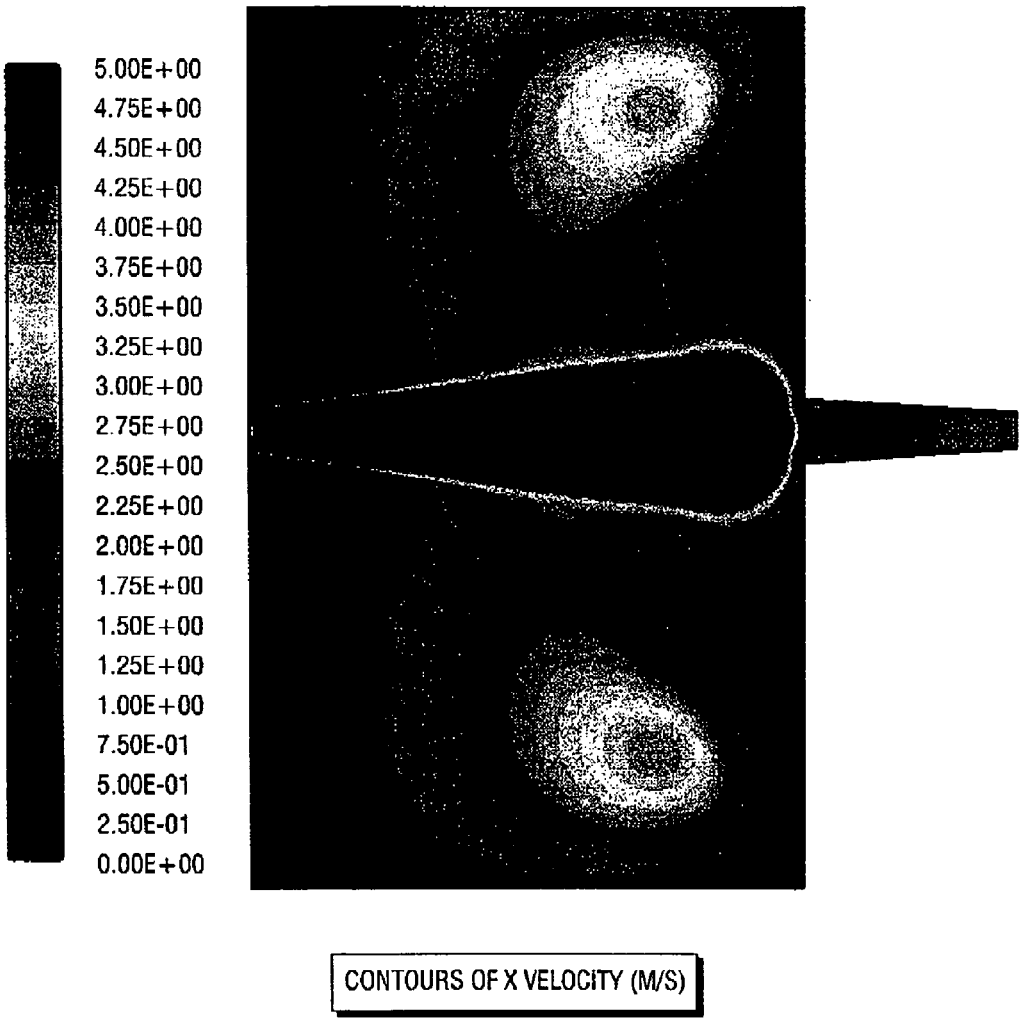
FIG. 7 is a graphical illustration of another velocity contour, according to an embodiment of the present invention.

When jet 44 is directed to the specific treatment section, the velocity contours are closely spaced where the acid or other reactive fluid contacts the formation, as illustrated in FIG. 6. FIG. 6 provides a diagram showing the flow field when an acidic fluid stream impinges on the surrounding wellbore wall to erode the wall. The diagram indicates an enhancement of the local mass transfer coefficient that results in preferential dissolution of the treatment area. Thus, the stimulation also is localized to the treatment area. In FIG. 7, a diagram is provided to show velocity contours for a fluid stream impinging on a wellbore wall in an open hole section of the wellbore after additional time has elapsed.

The methodology for stimulating a subterranean formation can be used in conjunction with various technologies to control fluid placement in well treatments. For example, once the stimulated region penetrates a desired distance into the formation via, for example, worm holes 62, a diverter can be injected to temporarily plug the stimulated region before moving jet 44 to another zone of interest along wellbore 22. This process can be repeated for each treatment section, e.g. each reservoir layer 28. By way of example, the diverter may comprise gelled fluids or particulates.

Upon creating the localized regions of enhanced permeability, a main or primary treatment can be performed in which a second treatment fluid, i.e. primary treatment fluid, is injected into the formation. The primary well treatment is enhanced due to the substantially altered permeability distribution along the well that results from creating the localized regions of enhanced permeability.

Accordingly, if a permeability contrast exists in the reservoir and it is desirable to stimulate zones having a permeability too low to take fluids during the main treatment, the present methodology can be used to prepare the low permeability zones for injection by stimulating them with jet streams 44 prior to the main treatment. The main or primary treatment procedure can vary from one application to another. However, examples of primary treatments include matrix treatments, such as bullhead and coiled tubing treatments as well as treatments in which fluids are injected through coiled tubing or through the coiled tubing/tubing annulus. Other examples of primary treatments include fracture stimulation treatments, e.g. hydraulic fracturing with acids and/or proppant, and scale control treatments.

Depending on the specific environment and treatment operations, a variety of sensors 50 can be used to monitor penetration of the stream 44 and other downhole parameters. Examples of suitable sensors include temperature sensors, pressure sensors and/or flow sensors. Data from the sensors can be transmitted to surface unit 48 via a variety of wired and wireless telemetry systems. For example, the data can be transmitted to the surface via optical signals, electric signals, or other suitable signals. Additionally, surface unit 48 may be a computer-based system able to process the data and display information to an operator for real-time interpretation. The data also can be recorded for post treatment evaluation. In many applications, the transference and interpretation of data in real-time enables monitoring and optimization of treatment in real-time. For example, the treatment can be optimized by adjusting the fluid jets 44. In some applications, the pressurized stream of fluid is adjustable by changing pressure, direction, location, number of jets and composition/nature of the reactive fluid. By way of example, the reactive fluid can be changed by adjusting the concentration of acid, surfactants, particulates, polymers, and other additives and components of the reactive fluid.

Figure 9:
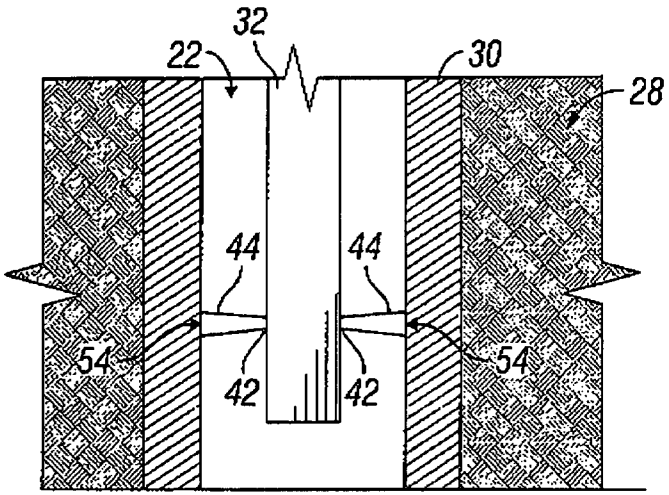
FIG. 9 is a schematic illustration of another embodiment of a stimulation tool that creates a plurality of jets, according to an alternate embodiment of the present invention.
Figure 8:
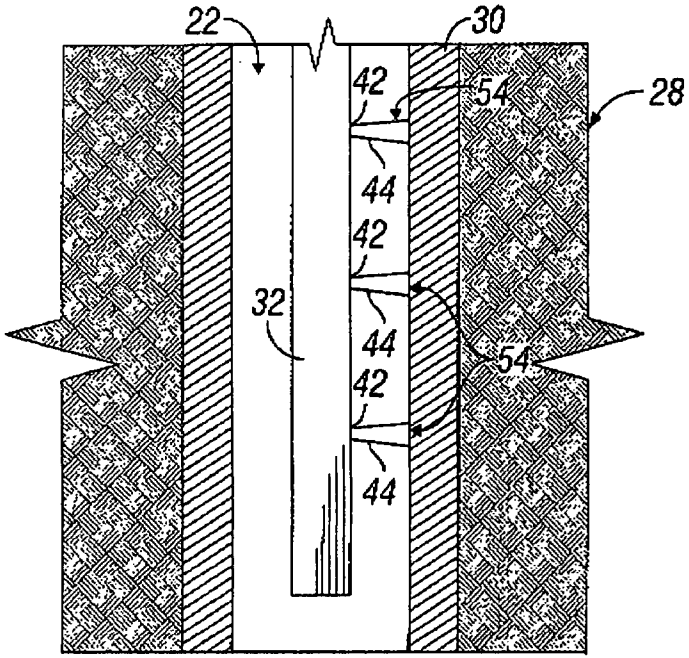
FIG. 8 is a schematic illustration of another embodiment of a stimulation tool that creates a plurality of jets, according to an alternate embodiment of the present invention.

The number and arrangement of jet nozzles 42 is selected to produce a desired jet stream configuration that can be used to optimize the stimulation operation. As illustrated in FIG. 8, for example, a plurality of jet nozzles 42 can be arranged to create a plurality of sequential jets 44 arranged generally linearly along well tool 32. By way of example, well tool 32 may comprise a section of coiled tubing. In other embodiments, the jet nozzles are arranged to locate a plurality of jets 44 at various circumferential positions, as illustrated in FIG. 9. These and other configurations enable simultaneous stimulation of multiple treatment sections along wellbore 22. Additionally, the nozzles 42 may have various shapes and sizes to maximize penetration of the surrounding reservoir. In some applications, the nozzles 42 are mounted in cooperation with valves controlled from surface unit 48 to enable closing and opening of the jet nozzles at will or according to a preprogrammed schedule.

Figure 10:
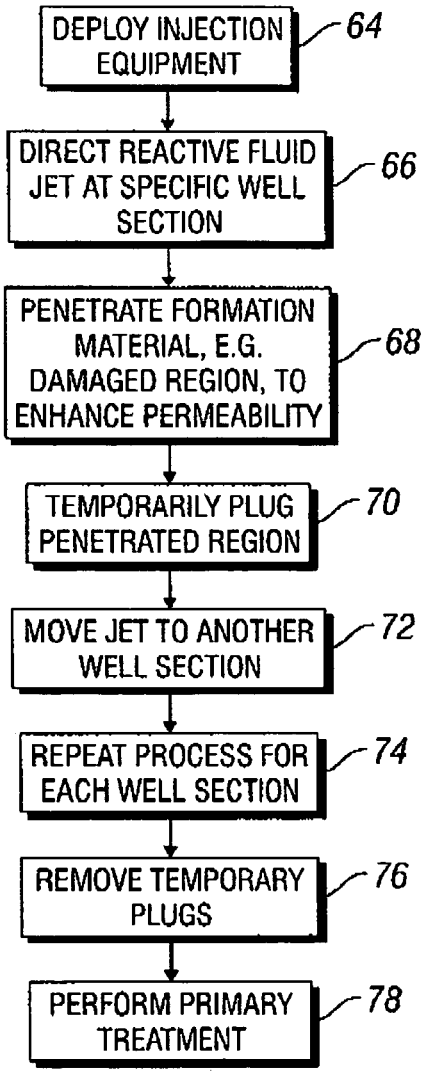
FIG. 10 is a flowchart illustrating one example of a stimulation procedure, according to an embodiment of the present invention.

In operation, system 20 is utilized according to a variety of procedures that depend on the environment, downhole equipment, reactive fluid, and other factors related to the specific well stimulation operation. One example of a methodology for stimulating a subterranean formation is illustrated by the flowchart of FIG. 10. According to this embodiment, the injection or well stimulation equipment is initially deployed into wellbore 22, as represented by block 64. The well tool 32 is moved into proximity with a specific treatment section of the well, and the reactive fluid is discharged as a jet against the specific well section, as illustrated by block 66. The jet or stream of fluid is maintained until the low permeability formation material is sufficiently penetrated to enhance permeability, as illustrated by block 68.

Once the initial penetration is formed, the penetrated region is temporarily plugged, as illustrated by block 70. The penetrated region can be temporarily plugged with a suitable particulate or gelled fluid blocking material. The well tool 32, along with its one or more jet nozzles 42, is then moved to another well treatment section, so the jet can be directed against another region of low permeability, as illustrated by block 72. This process is repeated to create the desired penetrations at each well treatment section, as illustrated by block 74.

After creating the desired penetrations at each well treatment section, the temporary plugs can be removed, as illustrated by block 76. Removal of the plugs enables performance of the primary well treatment, e.g. stimulation, operation, as illustrated by block 78. The use of jets 44 to penetrate regions of low permeability substantially changes the initial permeability distribution along the well and enables a much more successful primary treatment operation.

As described above, system 20 can be constructed in a variety of configurations for use in many environments and treatment applications. Additionally, system 20 may comprise a variety of well tools and well tool components to facilitate the stimulation of low permeability regions along a wellbore. For example, stabilizers can be used to position and hold the jet stream eccentric to the well to maximize penetration in certain applications. Additionally, centralizers can be used to position the support for multiple streams in other applications. The reactive fluids, pumping equipment, jet nozzles, and other equipment also can be adjusted to facilitate the stimulation operation for a variety of rock materials in a variety of well environments. Similarly, the number, orientation and intensity of the fluid jets can be adjusted from one application to another.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of stimulating a subterranean formation, comprising:

identifying at least one specific treatment section within the subterranean formation from a permeability contrast in the formation, the specific treatment section comprising a section with a low permeability;

conveying a tubing into a wellbore;

preparing the specific treatment section of the formation for a main treatment by selectively stimulating the treatment section, wherein selectively stimulating comprises:

delivering a reactive fluid downhole into the wellbore through a stimulation tool attached to the tubing, the stimulation tool comprising one or more jet nozzles and one or more sensors configured to monitor downhole parameters of the jet;

directing a jet of the reactive fluid to impinge on a location of the wellbore wall adjacent the specific treatment section of the formation;

using at least one of the downhole sensors on the stimulation tool to monitor penetration of the jet;

maintaining the jet until a localized region of enhanced permeability is created by the reactive fluid dissolving a low permeability reservoir material and forming worm holes in the formation; and temporarily plugging the worm holes in the wellbore created by the jet of reactive fluid;

repeating preparing, selectively stimulating, and plugging at least another treatment section to create a plurality of localized regions having enhanced permeability, wherein repeating comprises moving the jet and the tubing to a different treatment section;

removing the plugged worm holes along the wellbore; and delivering a main treatment fluid into the formation after creating the plurality of localized regions and after removing the plugs from the worm holes, wherein a flow of the main treatment fluid into the localized regions is optimized by the localized region and the worm holes and wherein preparing the treatment section and delivering the main treatment fluid comprise separate operations.

2. The method as recited in claim 1 wherein directing comprises directing the jet via nozzles in the stimulation tool controlled by a control unit at the surface of the wellbore.

3. The method as recited in claim 2, wherein the nozzles are mounted in cooperation with valves controlled from the control unit to enable closing and opening of the nozzles at will or according to a preprogrammed schedule.

4. The method as recited in claim 1 wherein delivering a main treatment fluid comprises delivering a matrix treatment, a fracture stimulation treatment or a scale control treatment.

5. The method as recited in claim 1, wherein delivering comprises delivering an acid downhole.

6. The method as recited in claim 1, wherein directing comprises directing a single jet.

7. The method as recited in claim 1, wherein directing comprises directing a plurality of jets simultaneously.

8. The method as recited in claim 1, wherein maintaining comprises maintaining the jet until an area damaged has been penetrated.

9. The method as recited in claim 1, wherein maintaining comprises maintaining the jet until a filter cake layer and a subsequent layer of carbonate rock are penetrated.

10. The method as recited in claim 1, further comprising optimizing the directing of the jet in real-time based on the monitored penetration of the jet.

11. The method as recited in claim 10, wherein optimizing comprises adjusting one of a pressure of the reactive fluid, a direction of the jet, a location, and a number of jets.

12. The method as recited in claim 10, wherein optimizing comprises adjusting the composition or nature of the reactive fluid by adjusting one of a concentration of acid, a surfactant, a particulate, a polymer, and other additives and components of the reactive fluid.

13. The method as recited in claim 1, wherein the reactive fluid comprises an acidic fluid, a neutral fluid, or a basic fluid for penetrating or eroding the treatment section.

14. The method as recited in claim 1, wherein maintaining comprises cleaning out perforations or cleaning out gravel packs.

15. A method of selectively stimulating a subterranean formation penetrated by a wellbore, the method comprising:

identifying at least one region of low permeability within the wellbore;

providing a reactive formation treatment fluid for stimulating a subterranean formation penetrated by a wellbore by providing an acidic treatment fluid that chemically reacts with the formation;

transporting the reactive formation treatment fluid through a tubular and a stimulation tool to a targeted depth corresponding to the region of low permeability in the wellbore, the stimulation tool comprising one or more jet nozzles and one or more sensors configured to monitor downhole parameters;

transferring the reactive formation treatment fluid under sufficient fluid pressure from the stimulation tool to the wall of the wellbore until the fluid penetrates through a layer of filter cake and subsequently chemically reacts with the formation to create a localized region of enhanced permeability in the formation proximate the wellbore by dissolving the formation with the reactive treatment fluid and forming worm holes in the formation;

temporarily plugging the worm holes in the wellbore created by the jet of reactive treatment fluid;

creating regions of enhanced permeability at a plurality of reservoir layers by moving the tubular and stimulation tool to a plurality of well treatment sections having low permeability along the wellbore;

using at least one of the downhole sensors on the stimulation tool to monitor penetration of the jet;

removing the plugged worm holes; and treating the formation with a second treatment fluid after transferring and creating the regions of enhanced permeability and after removing the plugs from the worm holes, the regions of enhanced permeability and worm holes enabling controlled placement of the second treatment fluid.

16. The method as recited in claim 15, further comprising selecting the reactive formation treatment fluid to react with the formation and erode the formation proximate the wellbore.

17. The method as recited in claim 15, wherein treating the formation with a second treatment fluid comprises treating the formation with a matrix treatment, a fracture stimulation treatment, or a scale control treatment.

18. The method as recited in claim 15, wherein the formation comprises a carbonate formation or a sandstone formation.

19. A method of stimulating a subterranean formation, comprising:

identifying at least one specific treatment section within the subterranean formation from a permeability contrast in the formation, the specific treatment section comprising a section with a low permeability;

conveying a coiled tubing into a wellbore;

preparing the specific treatment section of the formation for a main treatment by selectively stimulating the treatment section, wherein selectively stimulating comprises:

delivering a reactive fluid downhole into the wellbore through a stimulation tool attached to the tubing, the stimulation tool comprising one or more jet nozzles and one or more sensors configured to monitor downhole parameters of the jet;

directing a jet of the reactive fluid to impinge on a location of the wellbore wall adjacent the specific treatment section of the formation;

using at least one of the downhole sensors on the stimulation tool to monitor penetration of the jet;

maintaining the jet until a localized region of enhanced permeability is created by the reactive fluid dissolving a low permeability reservoir material and forming worm holes in the formation; and temporarily plugging the worm holes in the wellbore created by the jet of reactive fluid;

repeating preparing, selectively stimulating, and plugging at least another treatment section to create a plurality of localized regions having enhanced permeability;

removing the plugged worm holes along the wellbore; and delivering a main treatment fluid into the formation after creating the plurality of localized regions and after removing the plugs from the worm holes, wherein a flow of the main treatment fluid into the localized regions is optimized by the localized region and the worm holes and wherein preparing the treatment section and delivering the main treatment fluid comprise separate operations.

* * * * *